US007911124B2

(12) United States Patent
Jin

(10) Patent No.: US 7,911,124 B2
(45) Date of Patent: Mar. 22, 2011

(54) ELECTRON EMISSION DISPLAY WITH SPACERS

(75) Inventor: Sung-Hwan Jin, Yongin-si (KR)

(73) Assignee: Samsung SDI Co., Ltd., Suwon-si, Gyeonggi-do (KR)

( * ) Notice: Subject to any disclaimer, the term of this patent is extended or adjusted under 35 U.S.C. 154(b) by 11 days.

(21) Appl. No.: 11/585,932

(22) Filed: Oct. 25, 2006

(65) Prior Publication Data

US 2007/0090742 A1 Apr. 26, 2007

(30) Foreign Application Priority Data

Oct. 26, 2005 (KR) ..... 10-2005-0101168

(51) Int. Cl.
*H01J 1/62* (2006.01)
*H01J 63/04* (2006.01)

(52) U.S. Cl. ..... 313/495; 313/496; 313/497; 313/292

(58) Field of Classification Search ..... 313/292, 313/495–497

See application file for complete search history.

(56) References Cited

U.S. PATENT DOCUMENTS

| | | | | |
|---|---|---|---|---|
| 5,726,529 | A * | 3/1998 | Dean et al. | 313/495 |
| 5,746,635 | A * | 5/1998 | Spindt et al. | 445/24 |
| 6,353,280 | B1 * | 3/2002 | Shibata et al. | 313/292 |
| 6,420,825 | B1 * | 7/2002 | Shinjo et al. | 313/495 |
| 6,566,794 | B1 | 5/2003 | Miyazaki | |
| 6,657,368 | B1 | 12/2003 | Kosaka et al. | |
| 6,777,868 | B1 * | 8/2004 | Kosaka et al. | 313/495 |
| 7,541,731 | B2 * | 6/2009 | Sata et al. | 313/496 |
| 2004/0047512 | A1 | 3/2004 | Handley et al. | |
| 2007/0046163 | A1 * | 3/2007 | Sata et al. | 313/292 |

FOREIGN PATENT DOCUMENTS

| | | |
|---|---|---|
| CN | 1 405 833 A | 3/2003 |
| CN | 1 411 024 A | 4/2003 |
| EP | 0 851 459 | 7/1996 |
| EP | 0 851 458 | 7/1998 |
| EP | 1 137 041 | 9/2001 |
| GB | 2 404 279 | 1/2005 |
| WO | WO 00/14764 A1 | 3/2000 |
| WO | WO 00/51153 | 8/2000 |

* cited by examiner

*Primary Examiner* — Nimeshkumar D Patel
*Assistant Examiner* — Thomas A Hollweg
(74) *Attorney, Agent, or Firm* — Lee & Morse, P.C.

(57) ABSTRACT

An electron emission display, including an electron emission unit on a first substrate, a light emission unit on a second substrate, the second substrate affixed to the first substrate and having the electron emission unit and the light emission unit positioned therebetween, and a plurality of spacers disposed between the first and second substrates, wherein each spacer of the plurality of spacers includes a spacer body and at least one coating layer disposed on the spacer body, and wherein each spacer of the plurality of spacers satisfies the proviso that $0.02<\rho2/\rho1<100$, where $\rho1$ is a specific resistivity of an outer-most coating layer disposed on the spacer body and $\rho2$ is a specific resistivity of an element in direct contact with the outer-most coating layer.

19 Claims, 9 Drawing Sheets

ELECTRON EMISSION DISPLAY WITH SPACERS

BACKGROUND OF THE INVENTION

1. Field of the Invention

The present invention relates to an electron emission display. In particular, the present invention relates to an electron emission display having an improved structure of spacers therebetween.

2. Description of the Related Art

In general, electron emission displays refer to devices capable of displaying images by extracting and accelerating electrons from a cathode electrode, hot or cold, toward phosphorescent layers in a vacuum environment.

Electron emission displays employing cold cathodes refer to devices having cathode electrodes that, instead of employing heat, emit electrons by application of a strong electric field between cathode and gate electrodes. In particular, electrons may be extracted from electron emission regions located in the cathode electrode and accelerated toward phosphorescent layers, thereby exciting the phosphorescent layers to emit visible light upon contact therebetween.

A conventional electron emission display may include an electron emission unit with electron emission elements, e.g., Field Emission Array (FEA), Surface Conduction Emission (SCE), Metal-Insulator-Metal (MIM), and Metal-Insulator-Semiconductor (MIS), on a first substrate, a light emission unit with phosphorescent layers on a second substrate, and a sealing member connecting the first and second substrates, such that the electron emission unit and light emission unit are enclosed in a vacuum environment, i.e., about $10^{-6}$ torr, between the first and second substrates.

The vacuum environment in the electron emission display may provide high compression therein due to the large pressure difference between the interior and the exterior thereof. Accordingly, a conventional electron emission display may also include a plurality of spacers coupled between the first and second substrates to support the structure thereof. The conventional spacers may be formed of a dielectric material, e.g., glass or ceramic, to minimize a potential for a short circuit between the cathode and gate electrodes on the first substrate and the anode electrode on the second substrate.

However, some electrons emitted during operation of the conventional electron emission display may collide with the conventional spacers, and, consequently, charge them with a positive or negative potential with respect to the material characteristic thereof. The charged spacers may alter the electric field in the electron emission display and, thereby, modify the trajectories of the electron beams. The modified trajectories may distort the correct color expressions and quality of the electron emission display.

Accordingly, there exists a need to improve the structure of the spacers in the electron emission display in order to minimize color and quality distortion therein.

SUMMARY OF THE INVENTION

The present invention is therefore directed to an electron emission display, which substantially overcomes one or more of the disadvantages of the related art.

It is therefore a feature of an embodiment of the present invention to provide an electron emission display having improved spacers structure capable of providing enhanced color expression and quality.

At least one of the above and other features and advantages of the present invention may be realized by providing an electron emission display, including an electron emission unit on a first substrate, a light emission unit on a second substrate, wherein the second substrate maybe affixed to the first substrate such that the electron emission unit and the light emission unit may be positioned therebetween, and a plurality of spacers disposed between the first and second substrates, wherein each spacer of the plurality of spacers may include a spacer body and at least one coating layer disposed on the spacer body, and wherein each spacer of the plurality of spacers may satisfy the proviso that $0.02<\rho2/\rho1<100$, where $\rho1$ may be a specific resistivity of an outer-most coating layer disposed on the spacer body and $\rho2$ may be a specific resistivity of an element in direct contact with the outer-most coating layer. The outer-most coating layer may have a secondary electron emission coefficient of about 1.

The at least one coating layer may be applied continuously to the spacer body. Additionally, the at least one coating layer may be formed of a metallic oxide or a carbonaceous material. The spacer body may be formed of a dielectric material.

Each spacer of the plurality of spacers may include a first coating layer and a second coating layer. The first coating layer may be between the body spacer and the second coating layer. The second coating layer may have a higher specific resistivity as compared to a specific resistivity of the spacer body and the first coating layer. The first coating layer may include any one of amorphous silicon doped with p-type impurities, amorphous silicon doped with n-type impurities, silicon nitride, or silicon carbide.

The electron emission display may further include a plurality of conductive layers, each conductive layer in communication with a respective spacer of the plurality of spacers. The plurality of conductive layers may be parallel to the first and second substrates. The electron emission display may include a plurality of conductive layers in communication with each spacer, wherein each conductive layer may be positioned between each spacer and the electron emission unit or between each spacer and the light emission unit.

The electron emission unit may include a plurality of electron emission regions and a plurality of driving electrodes, wherein the at least one conductive layer may be electrically connected to the plurality of driving electrodes.

The light emission unit may include a plurality of phosphor layers and an anode electrode, wherein the at least one conductive layer may be electrically connected to the anode electrode.

BRIEF DESCRIPTION OF THE DRAWINGS

The above and other features and advantages of the present invention will become more apparent to those of ordinary skill in the art by describing in detail exemplary embodiments thereof with reference to the attached drawings, in which.

DETAILED DESCRIPTION OF THE INVENTION

Figure 1:
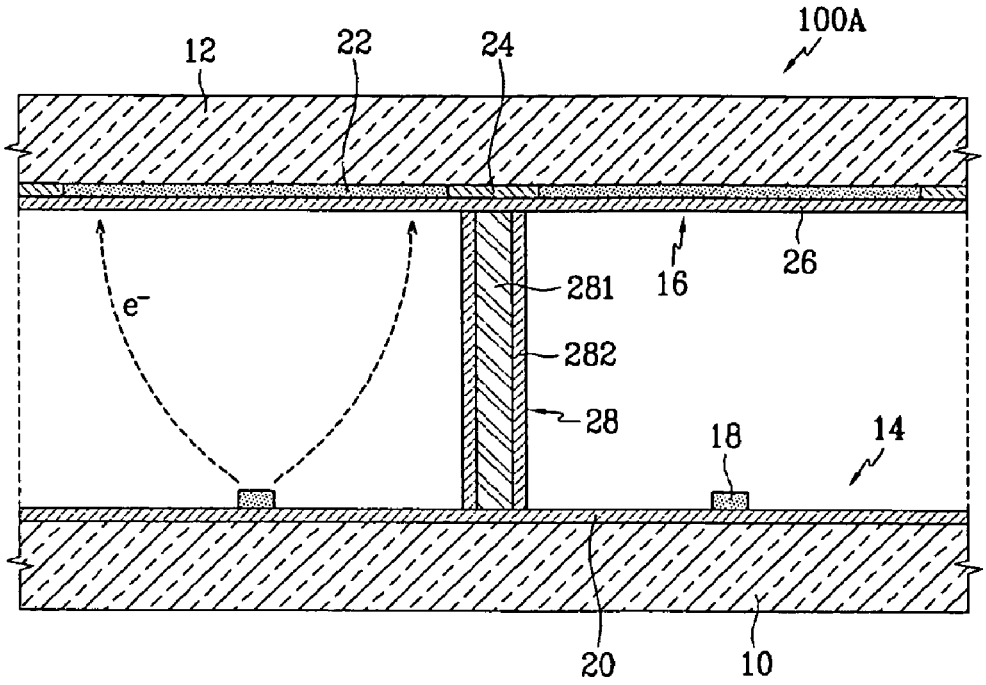
FIG. 1 illustrates a schematic partial sectional view of an electron emission display according to an embodiment of the present invention.

Korean Patent Application No. 10-2005-0101168 filed on Oct. 26, 2005, in the Korean Intellectual Property Office, and entitled: "Electron Emission Display with Spacer," is incorporated by reference herein in its entirety.

The present invention will now be described more fully hereinafter with reference to the accompanying drawings, in which exemplary embodiments of the invention are illustrated. The invention may, however, be embodied in different forms and should not be construed as limited to the embodiments set forth herein. Rather, these embodiments are provided so that this disclosure will be thorough and complete, and will fully convey the scope of the invention to those skilled in the art.

It will further be understood that when an element is referred to as being "on" another element or substrate, it can be directly on the other element or substrate, or intervening elements may also be present. Further, it will be understood that when an element is referred to as being "under" another element, it can be directly under, or one or more intervening elements may also be present. In addition, it will also be understood that when an element is referred to as being "between" two elements, it can be the only element between the two elements, or one or more intervening elements may also be present. Like reference numerals refer to like elements throughout.

An exemplary embodiment of an electron emission display according to the present invention is more fully described below with reference to FIG. 1. As illustrated in FIG. 1, an electron emission display 100A according to an embodiment of the present invention may include an electron emission unit 14 on a first substrate 10, a light emission unit 16 on a second substrate 12, a sealing member (not shown) to attach the first and second substrates 10 and 12 with the electron emission and light emission units 14 and 16, respectively, therebetween, such that a predetermined, pressure-controlled space may be formed therein, i.e., vacuum environment having pressure of about $10^{-6}$ torr, and a plurality of spacers 28. The first and second substrates 10 and 12 may be parallel to one another, and the electron emission unit 14 and the light emission unit 16 may face one another.

The electron emission unit 14 of the electron emission device 100A according to an embodiment of the preset invention may include a plurality of electron emission regions 18 and a plurality of driving electrodes 20 for controlling the amount of electrons emitted from the electron emission regions 18. In this respect, it should be noted that for explanatory convenience only, the driving electrodes 20 are schematically illustrated in FIG. 1 as one electrode layer.

The light emission unit 16 of the electron emission device 100A according to an embodiment of the preset invention may include a plurality of phosphor layers 22, a plurality of black layers 24, and an anode electrode 26.

The plurality of phosphor layers 22 may be disposed on a surface of the second substrate 12 and formed of any known phosphorescent material emitting red, green and blue light. The plurality of black layers 24 may be formed on the surface of the second substrate 12 adjacent to the phosphor layers 22 to enhance the contrast of the screen. For example, the plurality of black layers 24 may be formed between phosphor layers 22, such that each black layer 24 may be in direct communication with the second substrate 12 and two phosphor layers 22. The anode electrode 26 may be formed on the plurality of phosphor and black layers 22 and 24 in parallel thereto, such that the plurality of phosphor and black layers 22 and 24 may be positioned between the second substrate 12 and the anode electrode 26.

The anode electrode 26 may receive high voltage and, thereby, facilitate acceleration of electron beams from the first substrate 10 to the second substrate 12 and generate visible light in the phosphor layers 22 to further increase screen luminance of the electron emission display 100A. The anode electrode 26 may be formed of any known conductive material as determined by one of ordinary skill in the art, e.g., aluminum.

The plurality of spacers 28 of the electron emission device 100A according to an embodiment of the preset invention may be disposed between the first and second substrates 10 and 12 to support the structure of the electron emission display 100A, i.e., prevent structure collapse resulting from compression formed inside the electron emission display due to pressure difference with the exterior, and to maintain the predetermined distance between the first and second substrates 10 and 12. Each spacer 28 may be positioned to correspond to a respective black layer 24, as illustrated in FIG. 1. In other words, a contact plane between each spacer 28 and the light emission unit 16 may be within a width of a respective black layer 24 in order to prevent any overlap between the spacer 28 and the phosphor layers 22 and, thereby, minimize interference with light emission from the plurality of phosphor layers 22.

Each spacer of the plurality of spacers 28 may include a spacer body 281 and a coating layer 282. The spacer body 281 may be formed of any known dielectric material, e.g., glass, ceramic, reinforced glass, photosensitive glass, and so forth, in any convenient shape, such as a bar, a pillar, and so forth. The coating layer 282 may be continuously applied to the spacer body 281 at a thickness of about 200 to about 1,000 angstroms. In this respect, it should be not that "continuous application" or like terminology refers to application of the coating layer 282 to the spacer body 281, such that the coating layer 282 may cover the entire surface area of the spacer body 281 that may be in communication with the vacuum environment inside the electron emission display 100A. In other words, the coating layer 282 may provide a barrier layer to the spacer body 281, such that the surface of the spacer body 281 may not be exposed to the vacuum atmosphere.

The coating layer 282 may have electrical characteristics that are different from the electrical characteristics of the spacer body 281. For example, the coating layer 282 may be formed of a metallic oxide, such as chromium oxide, or a carbonaceous material, such as diamond-like carbon, thereby exhibiting a predetermined specific resistivity that is different than the specific resistivity of the spacer body 281. As such, the electrical characteristics of the coating layer 282 may affect and modify the overall electrical characteristics of the spacer 28.

More specifically, the specific resistivity of the coating layer 282 may be lower as compared to a specific resistivity of the spacer body 281. In this case and without intending to be bound by theory, it is believed that the coating layer 282 may function as a passage for the electrons. In other words, if electrons collide against the surface of a spacer 28, the coating layer 282 may redirect the colliding electrons toward the electron emission unit 14 or the light emission unit 16, thereby preventing contact between the spacer body 281 and the electrons, and, subsequently, avoiding surface-charging of the spacer 28.

Alternatively, the specific resistivity of the coating layer 282 may be higher as compared to the specific resistivity of the spacer body 281. In this case and without intending to be bound by theory, it is believed that the spacer body 281, as opposed to the coating layer 282, may function as a passage for the electrons. Accordingly, the coating layer 282 may be formed to have a secondary electron emission coefficient of about 1, thereby preventing the spacers 28 from being surface-charged more effectively. In this respect, it should be noted that a "secondary electron emission coefficient" refers to the number of electrons emitted from a surface per electron incident on the surface.

The electron emission display 100A according to an embodiment of the present invention may be driven by application of a predetermined voltage to the plurality of driving electrodes and anode electrode 26. More specifically, the anode electrode 26 may receive voltage that is several hundreds to several thousands volts higher than the voltage applied to the electrodes in the electron emission unit 14, thereby providing gradual voltage elevation in the vacuum environment between the first and second substrates 10 and 12. Accordingly, upon emission of a predetermined amount of electrons from the electron emission regions 18 into the predetermined space between the electron emission unit 14 and the light emission unit 16, the anode electrode 26 may accelerate the electrons toward the phosphor layers 22 due to its significantly higher voltage. The accelerated electrons may collide against the phosphor layers 22 to emit light and form images.

Upon emission from the electron emission regions 18 and acceleration toward the phosphor layers 22, some of the emitted electrons may collide with the spacers 28. However, as described previously and without intending to be bound by theory, it is believed that the structure of the spacers 28 according to an embodiment of the present invention is advantageous because it may prevent surface charging of the spacers 28 due to collision with electrons.

According to another embodiment of the present invention illustrated in FIG. 2, an electron emission display 100B may be similar to the electron emission display 100A described with reference to FIG. 1, with the exception that the electron emission display 100B may include a plurality of spacers 28'.

The plurality of spacers 28' of the electron emission device 100B according to an embodiment of the preset invention may be disposed between the first and second substrates 10 and 12 and correspond to the black layers 24. Additionally, each spacer of the plurality of spacers 28' may include a spacer body 281, a first coating layer 283 formed on the spacer body 281, and a second coating layer 284 formed on the first coating layer 283.

The first coating layer 283 may be applied to the spacer body 281, such that the first coating layer 283 may cover all the surface area of the spacer body 281 that may be in communication with the vacuum environment inside the electron emission display 100B. Additionally, the first coating layer 283 may be formed of amorphous silicon doped with p-type or n-type impurities, silicon nitride (SiN), silicon carbide (SiC), or any other suitable material known in the art.

The second coating layer 284 may be applied to the first coating layer 283. Additionally, the second coating layer 284 may be formed of a material identical to that of the coating layer 282 employed in the embodiment described with reference to FIG. 1. The second coating layer 284 may have a specific resistivity that is higher than the specific resistivity of the body 281 and the first coating layer 283. Accordingly, and without intending to be bound by theory, it is believed that surface-charging of the spacers 28' upon electron collision therewith may be minimized more efficiently.

According to another embodiment of the present invention illustrated in FIG. 3, an electron emission display 100C may be similar to the electron emission displays 100A and 100B described with reference to FIGS. 1-2, with the exception that the electron emission display 100C may include a plurality of conductive layers 286.

For illustration convenience, it should be noted that the plurality of spacers in the electron emission display 100C will be referred to as spacers 28, i.e., spacers having a structure identical to the structure of the spacers 28 described previously with respect to FIG. 1. However, other spacers embodiments, e.g., spacers 28' described previously with respect to FIG. 2, are not excluded from the scope of the embodiment described with respect to FIG. 3.

The plurality of spacers 28 of the electron emission device 100C according to an embodiment of the preset invention may be disposed between the first and second substrates 10 and 12 and correspond to the black layers 24. Additionally, each spacer of the plurality of spacers 28 may have a structure identical to the structure of the spacers 28 or the spacers 28' described previously with respect to FIGS. 1-2, respectively.

At least one conductive layer 286 may be formed between each spacer 28 and either the light emission unit 16, e.g., between the spacer 28 and the anode 26, or the electron emission unit 14, e.g., between the spacer 28 and the driving electrodes 20. Accordingly, the at least one conductive layer 286 may be in electrical communication with either the driving electrode 20 or the anode electrode 26. Alternatively, two conductive layers 286 may be disposed on each spacer 28, such that a conductive layer 286 may be applied between each spacer 28 and both the light emission unit 16 and the electron emission unit 14, as illustrated in FIG. 3. In this case, the conductive layer 286 may be in electrical communication with the driving electrode 20 and the anode electrode 26.

The at least one conductive layer 286 may be in communication with the spacer body 281 and the coating layer 282.

Without intending to be bound by theory, it is believed that the conductive layer 286 may lower the contact resistance between the spacer 28 and the driving electrode 20 and/or the anode electrode 26, thereby facilitating the redirection of the colliding electron flow.

The spacers 28 and 28' of the embodiments described above with reference to FIG. 1-3 may be formed to satisfy the condition of formula 1 below.

$$0.02<\rho2/\rho1<100 \qquad \text{Formula 1}$$

where $\rho1$ indicates a specific resistivity of an outer-most coating layer and $\rho2$ indicates a specific resistivity of an element in direct contact with the outer-most coating layer. In this respect, it should be noted that an "outer-most coating layer" refers to a coating layer disposed on the spacer body 281 and being in direct contact with the vacuum environment inside the electron emission display of the present invention. Further, "an element in direct contact with the outer-most coating layer" refers to the spacer body 281 or any other layer disposed between the outer-most coating layer and the spacer body 281. For example, with respect to the embodiment described with reference to FIG. 1, $\rho1$ indicates the specific resistivity of the coating layer 282, and $\rho2$ indicates the specific resistivity of the spacer body 281. Similarly, with respect to the embodiment described with reference to FIG. 2, $\rho1$ indicates the specific resistivity of the second coating layer 284, and ρ2 indicates the specific resistivity of the first coating layer 283.

Without intending to be bound by theory, it is believed that redirecting colliding electrons away from spacers 28 and 28' may minimize surface charge thereof, thereby reducing beam distortion, and, subsequently, suppressing secondary light emission caused by the electric charge of the spacers 28 and 28'. Suppression of secondary light emission may minimize visibility problems triggered by showing of the spacer on the screen, thereby improving color and picture quality of the electron emission display according to the present invention.

Figure 2:
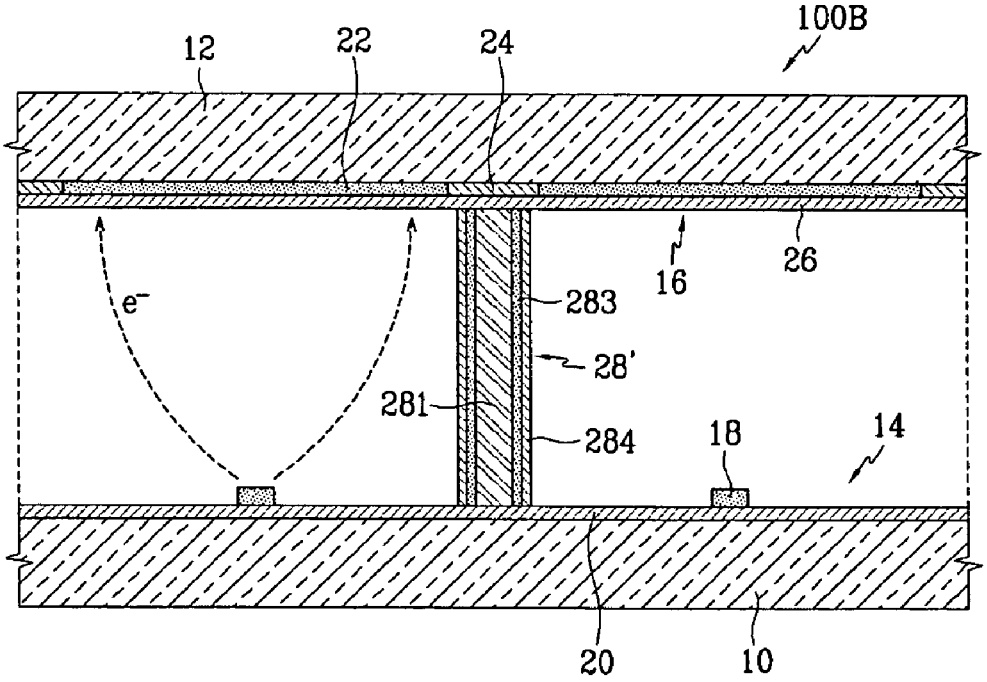
FIG. 2 illustrates a schematic partial sectional view of an electron emission display according to another embodiment of the present invention.
Figure 3:
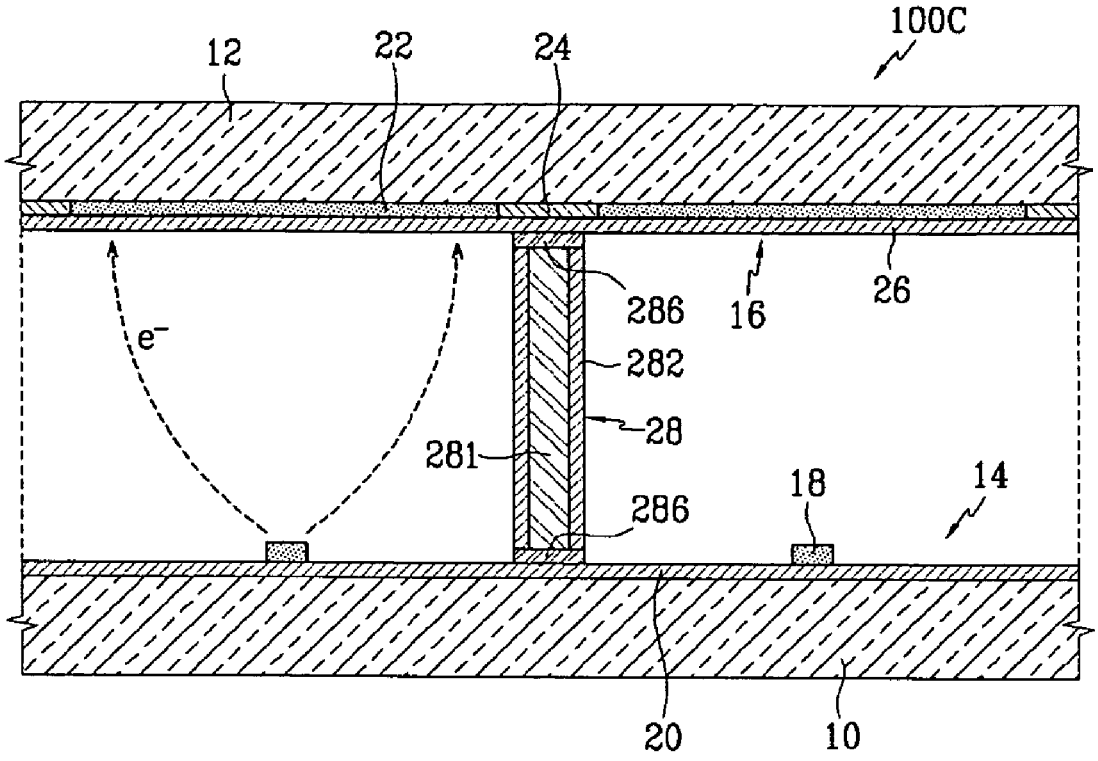
FIG. 3 illustrates a schematic partial sectional view of an electron emission display according to another embodiment of the present invention.

The electron emission displays 100A, 100B and 100C according to the embodiments described with respect to FIGS. 1-3 may be formed with different types of electron emission elements. For example, a FEA type electron emission display will be described in more detail with reference to FIGS. 4-5. In this respect, it should be noted that even though in the following exemplary embodiment of an electron emission display only FEA elements are described, other types of electron emission elements, e.g., SCE, MIM, or MIS, are not excluded from the scope of the present invention.

Figure 4:
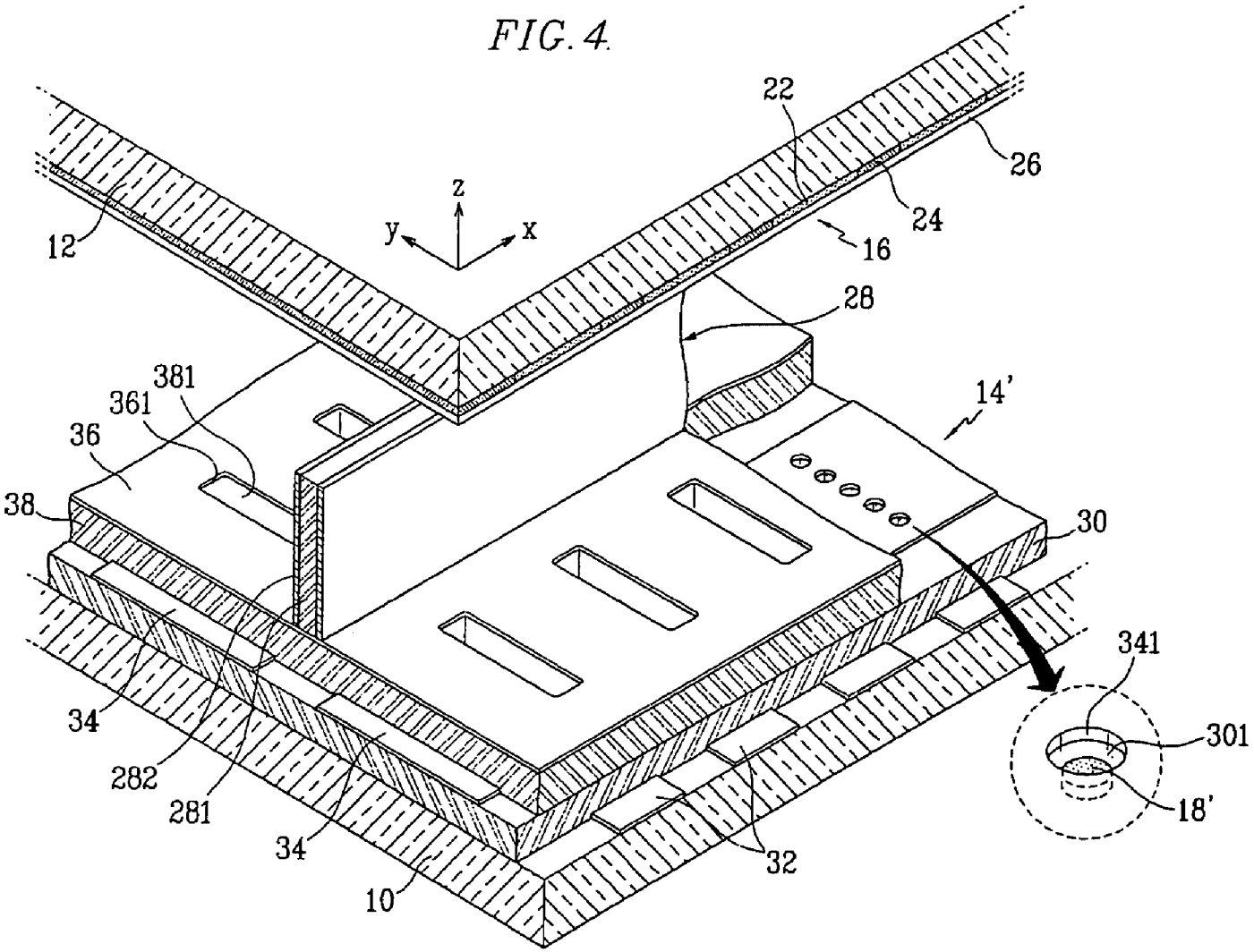
FIG. 4 illustrates a partial exploded perspective view of a field emission array type electron emission display according to an embodiment of the present invention.
Figure 5:
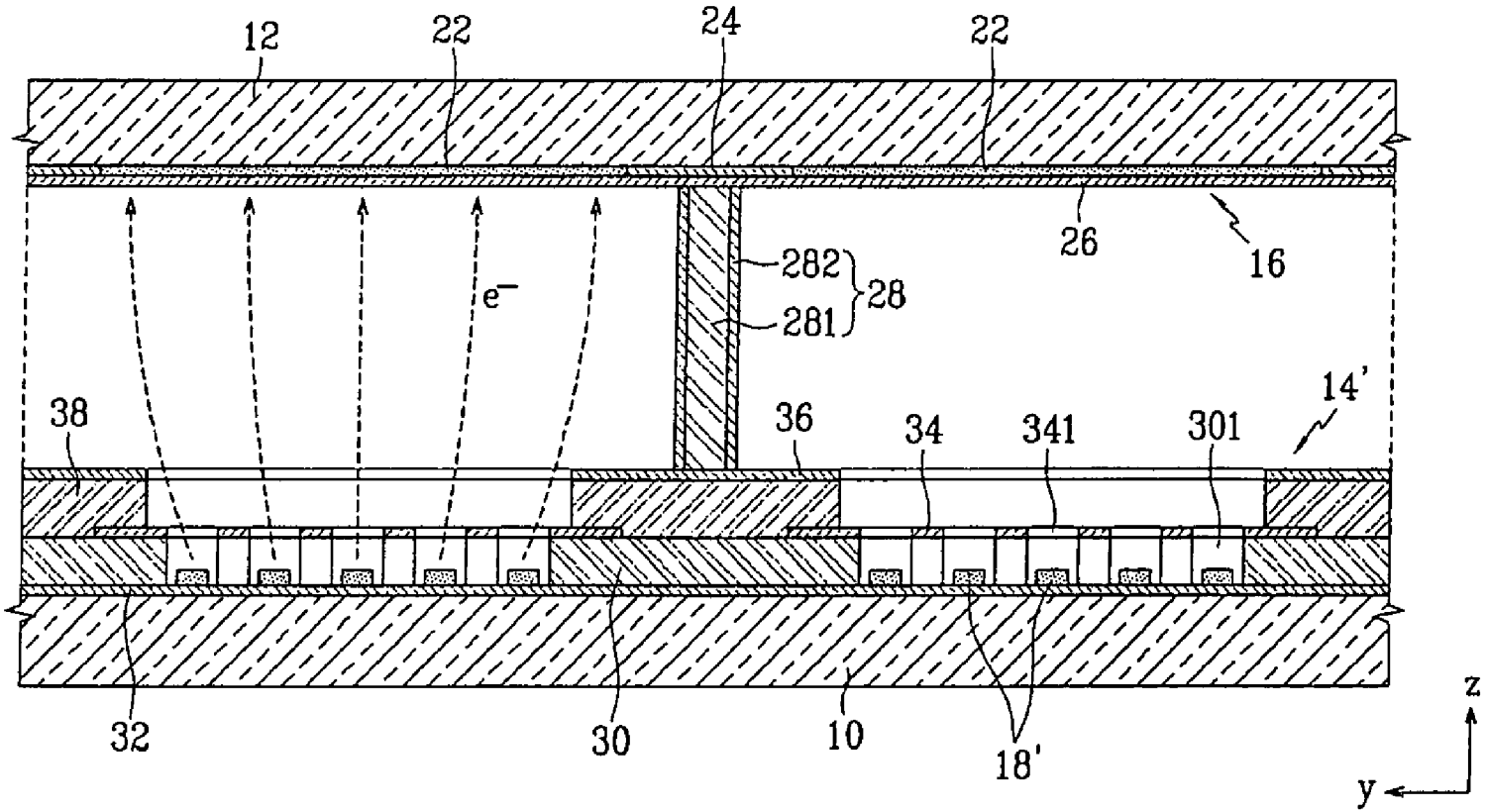
FIG. 5 illustrates a partial sectional view of a field emission array type electron emission display illustrated in FIG. 4.
Figure 6A:
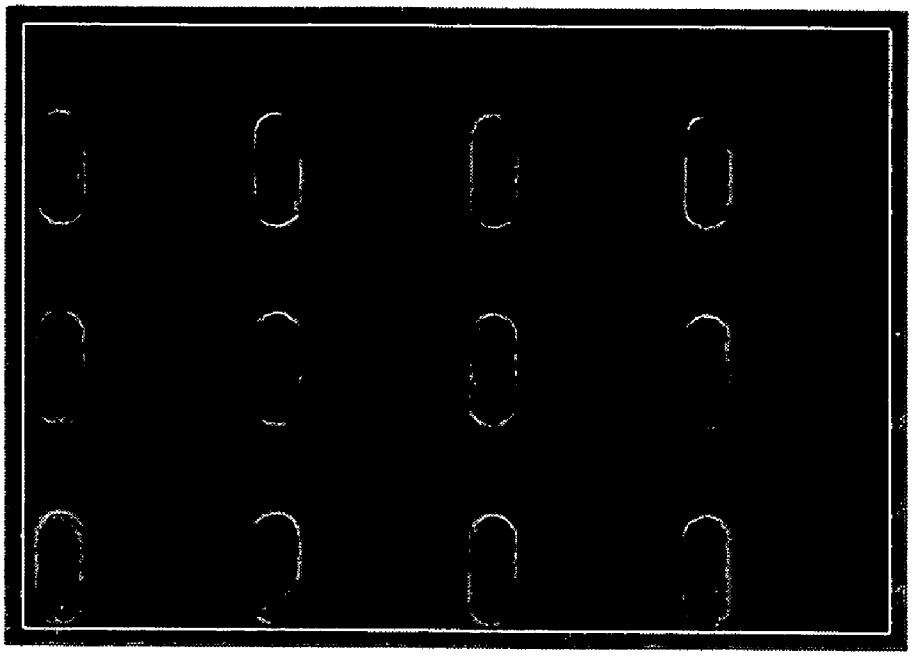
FIGS. 6A through 6D illustrate enlarged photographs of light emission states of respective electron emission displays with spacers according to embodiments of the resent invention.
Figure 6B:
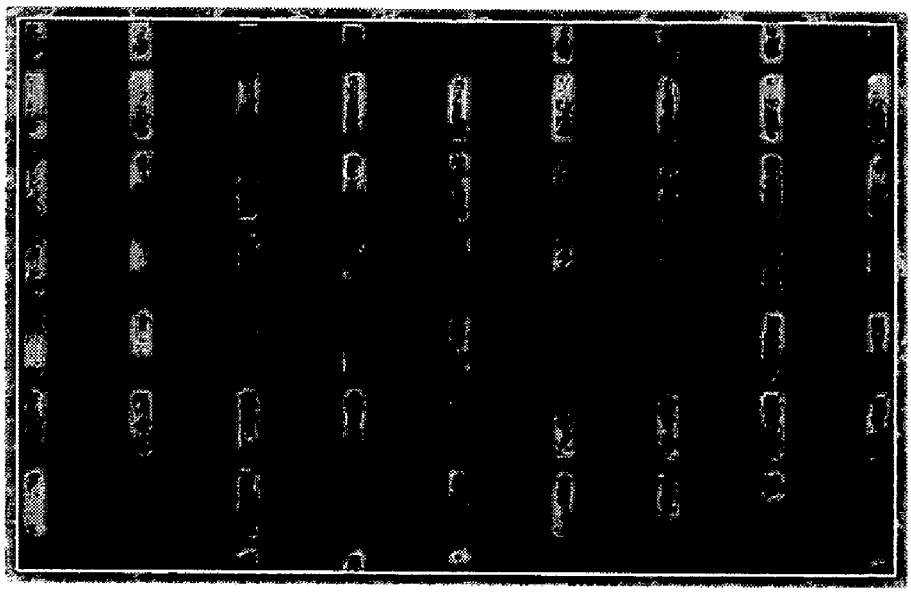
Figure 6C:
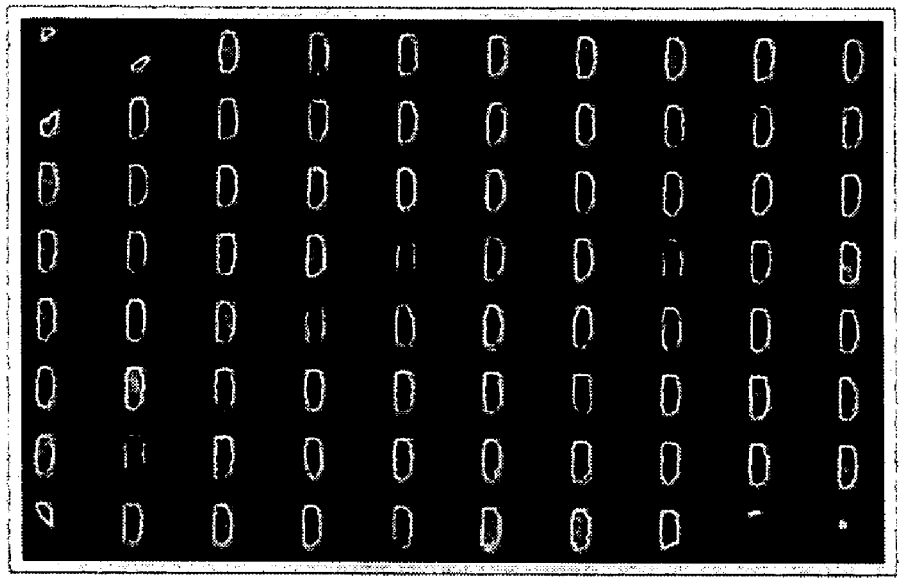
Figure 6D:
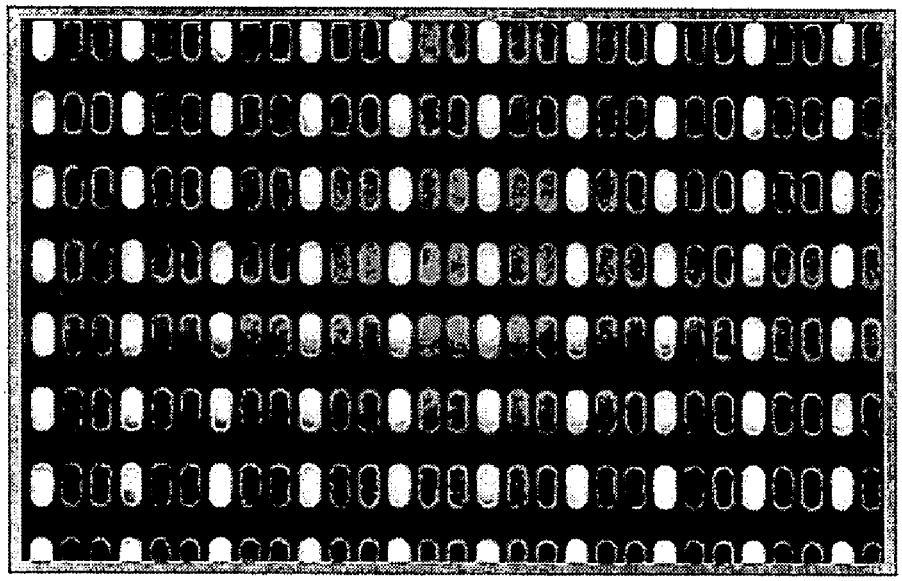
Figure 7A:
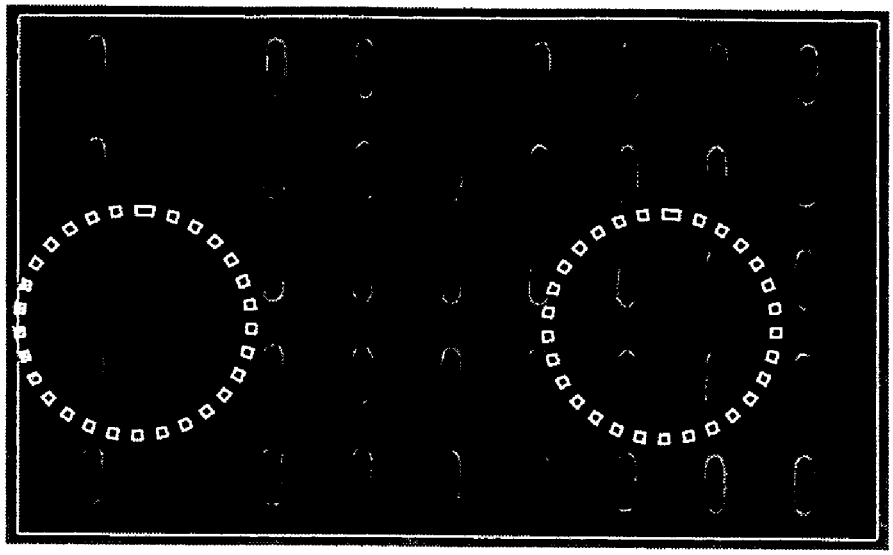
FIGS. 7A through 7E illustrate enlarged photographs of light emission states of respective electron emission displays with conventional spacers.
Figure 7B:
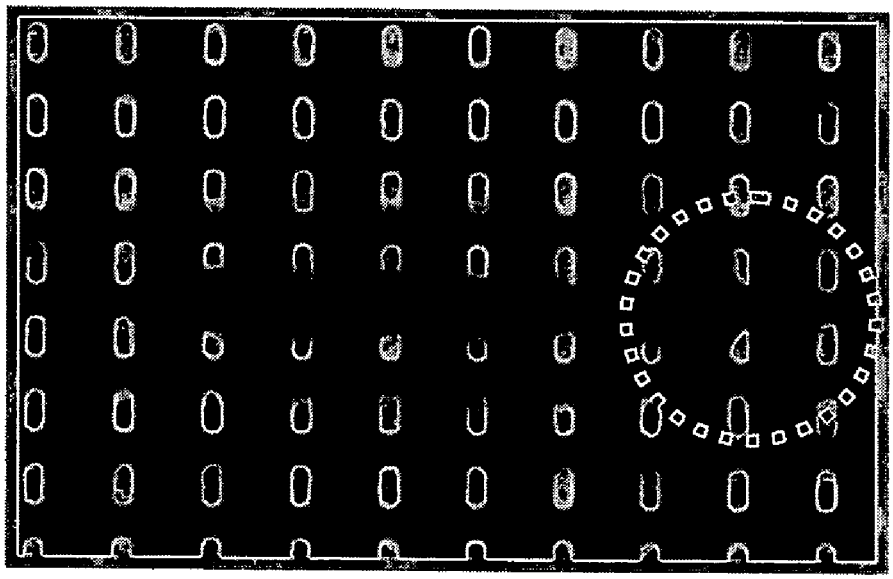
Figure 7C:
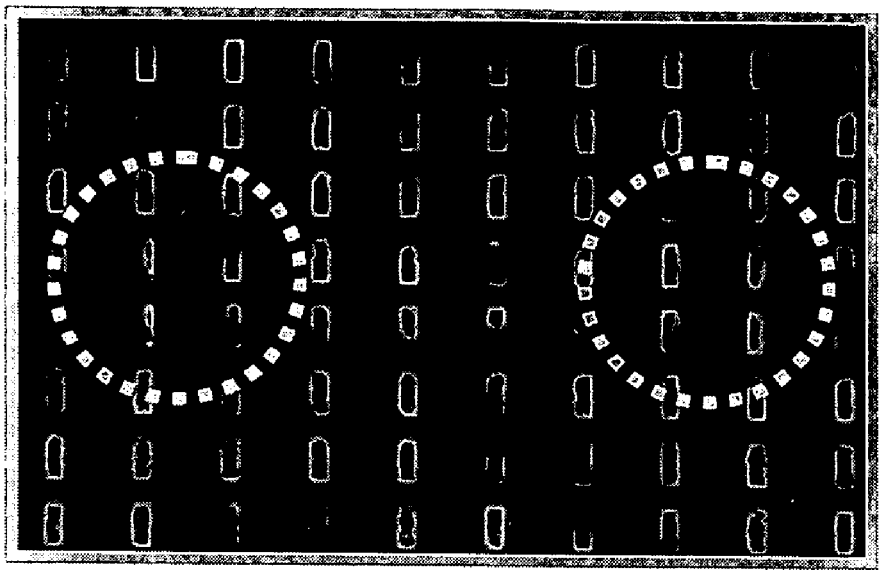
Figure 7D:
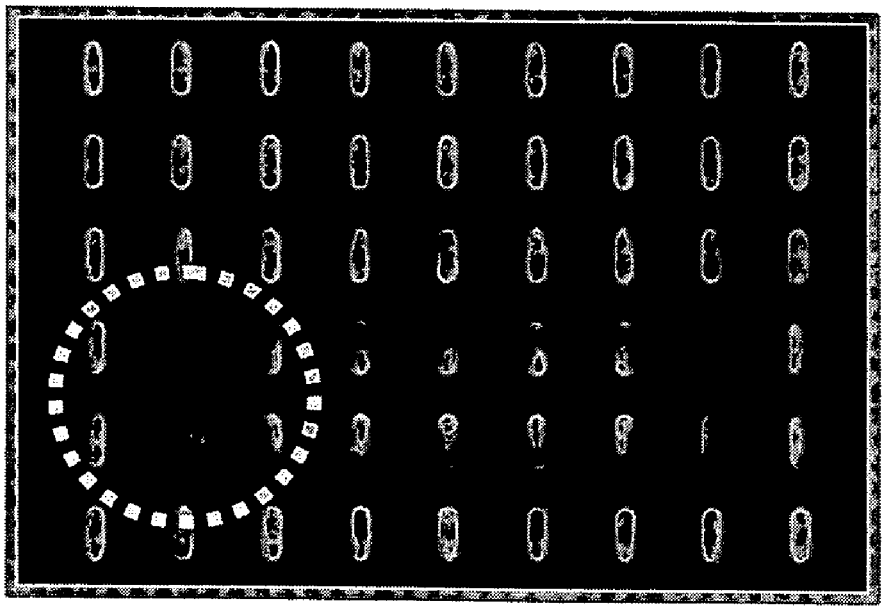
Figure 7E:
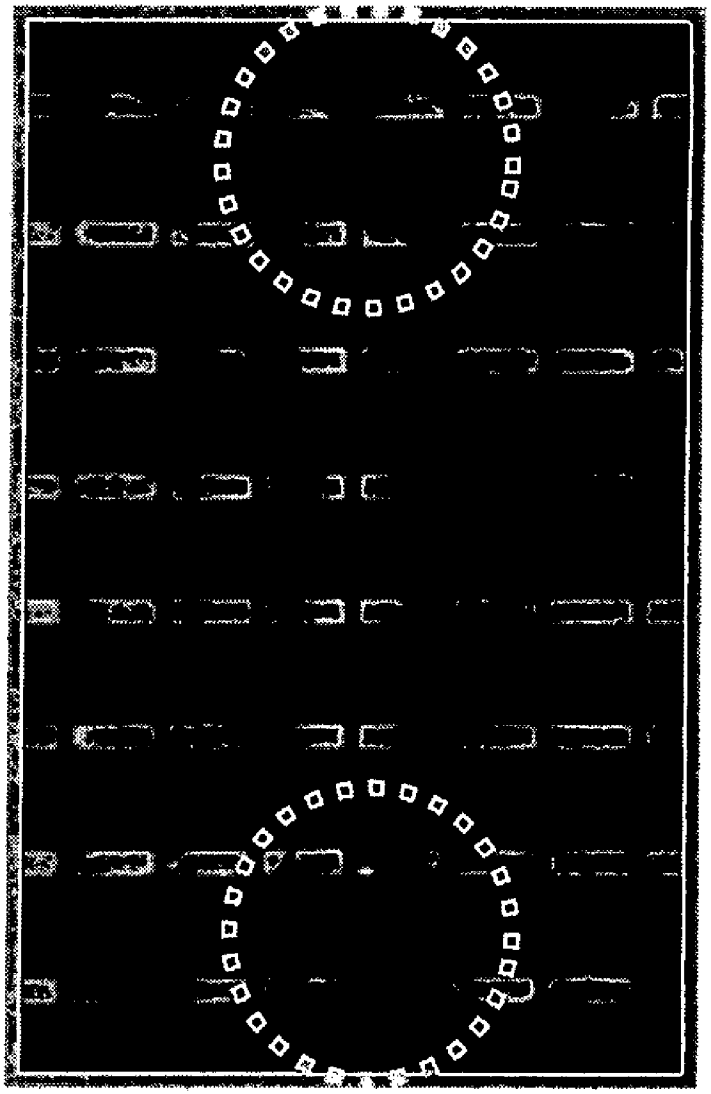

As illustrated in FIGS. 4-5, an FEA type electron emission display may include an electron emission unit 14', a light emission unit 16, and at least one spacer 28.

The electron emission unit 14' may include a plurality of electron emission regions 18', a plurality of parallel first electrodes 32, and a plurality of parallel second electrodes 34. The plurality of first and second electrodes 32 and 34 may be positioned perpendicularly to one another with the first insulating layer 30 disposed therebetween, such that each intersection region between the first and second electrode 32 and 34 may be referred to as a pixel unit.

The plurality of electron emission regions 18' may be electrically connected to any one of the first and the second electrodes 32 and 34. More specifically, the electron emission regions 18' may be formed in the plurality of first electrodes 32, thereby setting the plurality of first electrodes 32 as cathode electrodes for supplying electric currents to the electron emission regions 18'. Accordingly, the plurality of second electrodes 34 may be set as gate electrodes for establishing voltage difference with respect to the cathode electrodes, thereby forming an electric field for inducing electron emission from the electron emission regions 18'. Alternatively, the electron emission regions 18' may be formed in the plurality of first electrodes 32 in the plurality of second electrodes 34, thereby setting the second electrodes 34 as cathode electrodes and the first electrodes 32 as gate electrodes.

The emission regions 18' may be formed of any material having a low work function or a large aspect ratio and is capable of emitting electrons upon application of electric field thereto in a vacuum environment, e.g., carbonaceous material, nanometer-sized material, and so forth. For example, the electron emission regions 18' may be formed of carbon nanotubes, graphite, graphite nanofibers, diamonds, diamond-like carbon, $C_{60}$, silicon nanowires, a molybdenum-based material, a silicon-based material, or a combination thereof. If the electron emission regions 18' are formed of a molybdenum-based material or a silicon-based material, the electron emission regions 18' may be formed to have a pointed-tip structure.

As illustrated in FIG. 4, the electron emission unit 14' of the electron emission display according to an embodiment of the present invention may further include at least one first opening 301 and at least one second opening 341 that may be formed through the first insulating layer 30 and the second electrode 34, respectively, to expose the electron emission regions 18' formed on the first electrodes 32, such that emitted electrons may move from the electron emission regions 18' upward through the first and second openings 301 and 341, respectively. In other words, the first and second openings 301 and 341 may be formed directly above the electron emission regions 18' and across from the light emitting unit 16.

The electron emission unit 14' of the electron emission display according to an embodiment of the present invention may also include a second insulating layer 38. The second insulating layer 38 may be formed on the first insulating layer 30, such that the plurality of second electrodes 34 may be positioned therebetween.

The electron emission unit 14' of the electron emission display according to an embodiment of the present invention may also include a third electrode 36 to function as a focusing electrode. The third electrode 36 may be formed of a single layer and have a predetermined size. The third electrode 36 may be formed on the second insulating layer 38, such that the second insulating layer 38 may be positioned between the plurality of second electrodes 34 and the third electrode to separate therebetween.

The electron emission unit 14' of the electron emission display according to an embodiment of the present invention may further include at least one third opening 381 and at least one fourth opening 361 that may be formed through the second insulating layer 38 and the third electrode 36, respectively, to provide a path for electron beams from the electron emission regions 18'. In particular, the third electrode 36 may have a plurality of fourth openings 361, such that each fourth opening 361 may be formed to correspond to a respective electron emission region 18' to separately focus electrons emitted therefrom. Alternatively, the third electrode 36 may have a plurality of fourth openings 361, such that each fourth opening 361 may correspond to a plurality of respective electron emission regions 18' to collectively focus electron beams emitted from more than one electron emission region 18', as illustrated in FIG. 4. The at least one third opening 381 and at least one fourth opening 361 may be formed along the length of the third electrode 36, i.e., y-axis, to expose the plurality of electron emission regions 18' of each pixel unit.

The light emission unit 16 as well as the connection between the light emission unit 16 and the electron emission unit 14' may be identical to the description provided with respect to FIG. 1. Accordingly, detailed descriptions of elements will not be repeated herein.

The at least one spacer 28 may be disposed between the first and second substrates 10 and 12, as previously discussed with respect to FIGS. 1-3. As illustrated in FIG. 4, the spacers 28 may be formed as a partition positioned perpendicularly to the first substrate 10 of the electron emission unit 14' and in parallel to the plurality of second electrodes 34, i.e., the spacers 28 may be formed in the xz-plane.

The electron emission display according to an embodiment of the present invention may be driven by application of a predetermined voltage to the plurality of first electrodes 32, plurality of second electrodes 34, third electrode 36, and anode electrode 26. For example, the first electrodes 32 may function as scan electrodes receiving scan drive voltage, while the second electrodes 34 may function as data electrodes receiving data drive voltage. Alternatively, the functions of the first and second electrodes 32 and 34 may be switched. Further, the third electrode 36 may receive 0V or negative direct current voltage of several to tens volts, while the anode electrode 26 may receive a positive direct current voltage of hundreds to thousands of volts to facilitate acceleration of electron beams.

Without intending to be bound by theory, it is believed that application of voltage as described above may provide a voltage difference between the first and second electrodes 32 and 34 that is equal to or higher than a predetermined threshold value, thereby facilitating formation of an electric field around the electron emission regions 18' of each pixel unit having such voltage difference. Formation of such an electric field may, consequently, facilitate emission of electrons from the electron emission regions 18'. The emitted electrons may be attracted by the high voltage applied to the anode electrode 26, pass through the at least one fourth opening 361 of the third electrode 36, thereby focusing into an electron beam and striking the corresponding phosphor layers 22 to trigger an excitation state thereof and to generate light emission.

Some of the electrons emitted from the respective electron emission regions 18' toward the second substrate 12 may collide against the spacers 28. However, the inventive spacers 28 and 28' according to the embodiment of the present invention may minimize surface charging thereof, thereby reducing distortion of electron beams and preventing abnormal light emission.

EXAMPLES

An influence of spacers and their specific resistivity characteristics on operation of electron emission displays was tested. More specifically, six (6) spacers were prepared according to embodiments of the present invention. The six (6) inventive spacers and seven (7) conventional spacers were incorporated into thirteen (13) identical electron emission displays. The operation conditions of each electron emission display were identical in terms of voltage, vacuum pressure, and so forth.

Each electron emission display was tested to determine whether secondary light emission had occurred during operation thereof. For this purpose, the value of $\rho 2/\rho 1$ of the spacers in each electron emission display was modified, and the light emission was observed and recorded.

In this respect, secondary light emission refers to undesired light emitted from phosphor layers of the electron emission display due to distortion in the emitted electron beam. More specifically, when electric charge is created around the spacers of an electron emission display and modifies the electric field thereof, the electron beam emitted from the electron emission unit may deviate from its path, thereby causing electrons to impact incorrect surfaces and generate distorted colors and/or images, e.g., showing of a location of a spacer on a screen.

The six electron emission displays with the inventive spacers exhibited values of $\rho 2/\rho 1$ that correspond to formula 1 of the present invention. Further, the electron emission displays with the inventive spacers did not have secondary light emission occurrence. On the other hand, the seven electron emission displays with the conventional spacers did not correspond to the values of $\rho 2/\rho 1$ of the present invention. Further, all the electron emission displays with the conventional spacers exhibited secondary light emission.

The lack of secondary light emission occurrence in the electron emission displays with the inventive spacers may be further noted in FIGS. 6A-6D, where light emitting states of electron emission displays of respective spacers are illustrated. As illustrated in the photographs in FIGS. 6A-6D, no secondary light emission was observed. On the other hand, as illustrated in FIGS. 7A-7E by dotted circles, where light emitting states of electron emission displays of respective conventional spacers are illustrated, secondary light emission was observed. More specifically, it was observed that visibility problems occurred due to appearance of spacers on the screen, i.e., an electron beam path around each spacer was distorted due to the electric charge of the spacer, thereby causing darker areas on the screen.

Without intending to be bound by theory, it is believed that secondary light emission as illustrated in FIGS. 7A-7E may result when the outermost coating layer has a specific resistivity that is from about 0.01 to about 50 times higher than the resistivity of the element in direct contact with the outer-most coating layer, i.e., an inner coating or a spacer body. In other words, secondary light emission may occur when the spacer is not formed according to formula 1 of the present invention. It is further believed that a resistance at a surface boundary between the outermost coating layer and the element in direct contact with the outer-most coating layer, i.e., an inner coating or a spacer body, may vary quickly, thereby reducing the effectiveness of the coating layer performance in terms of suppressing the spacers surface-charge.

Exemplary embodiments of the present invention have been disclosed herein, and although specific terms are employed, they are used and are to be interpreted in a generic and descriptive sense only and not for purpose of limitation. Accordingly, it will be understood by those of ordinary skill in the art that various changes in form and details may be made without departing from the spirit and scope of the present invention as set forth in the following claims.

What is claimed is:

1. An electron emission display, comprising:

an electron emission unit on a first substrate;

a light emission unit on a second substrate, the second substrate affixed to the first substrate and having the electron emission unit and the light emission unit positioned therebetween; and a plurality of spacers disposed between the first and second substrates, wherein each spacer of the plurality of spacers includes a spacer body, a first coating layer, and a second coating layer, the first coating layer including amorphous silicon doped with p-type impurities or amorphous silicon doped with n-type impurities disposed on the spacer body and the second coating layer being an outer-most coating layer; wherein:

each spacer of the plurality of spacers satisfies the proviso that $0.02<\rho 2/\rho 1<100$, where $\rho 1$ is a specific resistivity of the outer-most coating layer disposed on each spacer body and $\rho 2$ is a specific resistivity of an element in direct contact with the outer-most coating layer, and the outer-most coating layer extends on the spacer body between the first and second substrates along an entire length of the spacer body.

2. The electron emission display as claimed in claim 1, wherein the outer-most coating layer has a secondary electron emission coefficient of about 1.

3. The electron emission display as claimed in claim 1, wherein the spacer body is formed of a dielectric material.

4. The electron emission display as claimed in claim 1, wherein the outer-most coating layer is formed of a metallic oxide or a carbonaceous material, the coating layer including amorphous silicon doped with p-type impurities or amorphous silicon doped with n-type impurities being between the spacer body and the outer-most coating layer.

5. The electron emission display as claimed in claim 1, wherein the first coating layer is between the spacer body and the second coating layer.

6. The electron emission display as claimed in claim 5, wherein the second coating layer has a higher specific resistivity as compared to a specific resistivity of the first coating layer.

7. The electron emission display as claimed in claim 5, wherein the first coating layer is in direct contact with the spacer body and the second coating layer.

8. The electron emission display as claimed in claim 1, further comprising a plurality of conductive layers, at least one conductive layer of the plurality of conductive layers being on a respective spacer of the plurality of spacers.

9. The electron emission display as claimed in claim 8, wherein the plurality of conductive layers is parallel to the first and second substrates.

10. The electron emission display as claimed in claim 9, wherein a plurality of conductive layers is on each spacer, each conductive layer positioned between the spacer and the electron emission unit or between the spacer and the light emission unit.

11. The electron emission display as claimed in claim 9, wherein the electron emission unit includes a plurality of electron emission regions and a plurality of driving electrodes.

12. The electron emission display as claimed in claim 11, wherein the at least one conductive layer is electrically connected to the plurality of driving electrodes.

13. The electron emission display as claimed in claim 9, wherein the light emission unit includes a plurality of phosphor layers and an anode electrode.

14. The electron emission display as claimed in claim 13, wherein the at least one conductive layer is electrically connected to the anode electrode.

15. The electron emission display as claimed in claim 1, wherein the second coating layer has a secondary electron emission coefficient of about 1 and covers substantially an entire length of the first coating layer.

16. An electron emission display, comprising:

an electron emission unit on a first substrate;

a light emission unit on a second substrate, the second substrate affixed to the first substrate and having the electron emission unit and the light emission unit positioned therebetween; and a plurality of spacers disposed between the first and second substrates, each spacer of the plurality of spacers including a spacer body, a first coating layer on the spacer body, and a second coating layer on the first coating layer, the first coating layer including amorphous silicon doped with p-type impurities or amorphous silicon doped with n-type impurities, and the second coating layer being an outer-most coating layer, wherein each spacer of the plurality of spacers satisfies the proviso that $0.02<\rho2/\rho1<100$, where $\rho1$ is a specific resistivity of the second coating layer and $\rho2$ is a specific resistivity of the first coating layer.

17. The electron emission display as claimed in claim 16, wherein the first coating layer is between the spacer body and second coating layer, the first layer completely overlapping the spacer body, and the second coating layer completely overlapping the first coating layer.

18. The electron emission display as claimed in claim 16, wherein the second coating layer includes a metallic oxide or a carbonaceous material.

19. The electron emission display as claimed in claim 16, wherein the second coating layer has a secondary electron emission coefficient of about 1 and covers substantially an entire length of the first coating layer.

* * * * *